US006722074B1

(12) United States Patent
Farrell

(10) Patent No.: US 6,722,074 B1
(45) Date of Patent: Apr. 20, 2004

(54) ADJUSTABLE RECOIL LUG FOR SCOPE-MOUNTING BASE

(75) Inventor: Kenneth L. Farrell, Sedalia, MO (US)

(73) Assignee: Farrell Industries, Inc., Warsaw, MO (US)

( * ) Notice: Subject to any disclaimer, the term of this patent is extended or adjusted under 35 U.S.C. 154(b) by 0 days.

(21) Appl. No.: 10/365,168

(22) Filed: Feb. 12, 2003

(51) Int. Cl.[7] ..... F41G 1/38
(52) U.S. Cl. ..... 42/124; 42/75.01
(58) Field of Search ..... 42/124, 125, 126, 42/75.01, 76.01

(56) References Cited

U.S. PATENT DOCUMENTS

| | | | | | |
|---|---|---|---|---|---|
| 2,575,653 | A | * | 11/1951 | Buehler | 42/124 |
| 3,259,986 | A | * | 7/1966 | Carr | 42/124 |
| 3,742,636 | A | * | 7/1973 | Dealy et al. | 42/111 |
| 3,834,052 | A | * | 9/1974 | Steck, III | 42/90 |
| 3,964,173 | A | * | 6/1976 | Atchisson | 42/136 |
| 5,941,006 | A | * | 8/1999 | Horton | 42/124 |

* cited by examiner

*Primary Examiner*—Michael J. Carone
*Assistant Examiner*—Denise J Buckley
(74) *Attorney, Agent, or Firm*—Hovey Williams LLP

(57) ABSTRACT

A firearm (10) constructed in accordance with the principles of a preferred embodiment of the present invention and configured for firing large caliber ammunition at precisely defined targets at long range is disclosed. The firearm (10) broadly includes a stock (12), a receiver (14) supported in the stock (12), a barrel (14*a*) threadably coupled to the receiver (14), hardware (16) associated with the receiver (14) for firing ammunition through the barrel (14*a*), a scope (18), and a scope-mounting base (20) coupled to the receiver (14) for mounting the scope (18) thereto in the line of sight. The base (20) includes a mount (24) adapted to be fixed to the receiver (14), an adjustable recoil lug (26) for anchoring the base (20) relative to the receiver (14), and a pair of ring clamps (28 and 30) for coupling the scope (18) to the base (20). The adjustable recoil lug (26) prevents undesired movement of the base (20) relative to the firearm (10) when the firearm (10) is fired and enables the lug (26) to be used on virtually any base with any firearm having an ejection port without the need to specially manufacture the lug (26) for the particular firearm. In a preferred embodiment, the mount (24) includes a recessed groove (44) operable to receive epoxy that enables a secure and level mounting on virtually any type of firearm. In the preferred embodiment, the improved ring clamps (28,30) include arcuate engagement surfaces (88, 90, 92) that enable a consistently uniform and optimized torque applied between the ring clamps (28,30) and the mount (24). An alternative embodiment is also disclosed wherein the firearm (200) includes a recoil-reduction device (202) and the scope-mounting base (204) includes both front and rear adjustable recoil lugs (206, 208).

22 Claims, 3 Drawing Sheets

ADJUSTABLE RECOIL LUG FOR SCOPE-MOUNTING BASE

BACKGROUND OF THE INVENTION

1. Field of the Invention

The present invention relates generally to firearms adapted to be mounted with a scope. More specifically, the present invention concerns an improved scope-mounting base including an adjustable recoil lug for preventing undesired movement of the base relative to the firearm when the firearm is fired. Additionally, the improved scope-mounting base enables a secure and level mounting on virtually any type of firearm. The improved base of the present invention also includes improved ring clamps that enable uniform and optimized torque applied between the ring clamps and the mount.

2. Discussion of Prior Art

It is desirable to utilize a scope to facilitate aiming a firearm in many shooting applications, particularly long-range target shooting using high-powered firearms and large caliber ammunition. Conventional scopes are typically mounted onto the firearm after market and enable a user to focus and magnify a target in the line of sight at distances well in excess of one-thousand yards. These scopes further allow the user to finely adjust the sighting provided by the scope to precisely match the particular firearm and the specific application. However, when the firearm is fired, significant recoil forces act on the firearm, as well as the scope mounted thereon. Accordingly, it is desirable to mount the scope to the firearm in a secure manner. It is further desirable to provide a mount that enables securement in a cost-effective manner that can be easily accomplished by the user after market, for a wide variety of scopes and firearms.

Scope bases for securing a scope to a firearm are known in the art. These prior art bases include a mount that is secured to the receiver of the firearm and adjustable ring clamps that clamp the scope to the mount. Prior art mounts typically are secured to the receiver of the firearm with a plurality of screws (e.g., many firearms come pre-drilled with 3,4 or 5 threaded holes in the top of the receiver). With these prior art bases, the recoil forces often undesirably cause the scope to loose its sight adjustment, become loosened, or in extreme cases shear off of the firearm. These problems are exacerbated when the scope is not tightly secured to the mount. While prior art bases attempt to secure the scope to the mount, they are deficient in most cases and typically achieve a loose, or "spongy" coupling between the scope and the mount.

For example, most prior art ring clamps utilize a movable jaw having flat, angled surfaces (e.g., forty-five degrees, etc.) that engage a weaver-style, cammed mount with complemental angled surfaces. The movable jaw is compressed by engaging the flat surface of a screw with a flat backside of the jaw. If everything is perfectly fit and centered, the moveable jaw creates a correct torque factor with the mount, i.e. a torque factor that evenly centers the clamping force over the center of the mount and securely couples the scope to the mount. However, as is most often and undesirably the case, when the jaw does not perfectly engage the mount (e.g., when the mount or jaw surfaces are not uniform, etc.), the torque is applied too high on the ring and an undesirable spongy connection is created between the scope and the mount, rendering recoil forces all the more likely to undesirably alter or damage the scope. Additionally, prior art mounts utilize an arcuate undersurface that roughly matches the arcuate top circumference of the receiver of the firearm. If the arcuate surfaces exactly match, the surfaces correctly marry and the mount is centered over the receiver. However, as is more often the case, where the arcuate surfaces do not match (e.g., where the receiver has been belt-sanded, etc.), the mount typically does not center over the receiver. It is known in the art to utilize an epoxy between the mount and the receiver to help alleviate this problem and to add to the mounting force. However, the mismatched arcuate surfaces are undesirable in this regard in that there is insufficient space for the epoxy and thus the epoxy tends to worsen the problem with securely centering the mount over the firearm receiver.

It is also known in the art to machine a "step" integral with the bridge of a weaver-style base mount that extends into the ejection port of the firearm and engages one or both of the faces thereof to assist in preventing the harmful effects of the recoil forces on the scope. These stepped bridges, however, are problematic and subject to several limitations. For example, the machined steps are difficult and costly to manufacture. In addition, each stepped mount must be custom made to fit the particular firearm it is mounted on because cartridge ejection ports are typically not uniform or consistent from firearm to firearm.

SUMMARY OF THE INVENTION

The present invention provides an improved scope-mounting base that does not suffer from the problems and limitations of the prior art bases detailed above. The inventive base includes an adjustable recoil lug for preventing undesired movement of the base relative to the firearm when the firearm is fired. The adjustability of the recoil lug enables the lug to be used on virtually any firearm having an ejection port without the need to specially manufacture the lug for the particular firearm. In a preferred embodiment, the mount includes a recessed groove operable to receive epoxy that enables a secure and level mounting on virtually any type of firearm. In a preferred embodiment, the improved base of the present invention also includes improved ring clamps including arcuate engagement surfaces that enable a consistently uniform and optimized torque applied between the ring clamps and the mount.

A first aspect of the present invention concerns a base for mounting a scope on a firearm wherein the firearm includes a cartridge ejection port presenting a front face and a rear face. The base broadly includes a mount adapted to be mounted on the firearm and a lug adjustably coupled to the mount. The mount includes a bridge section extending over the ejection port when the mount is mounted on the firearm. The lug projects out of the bridge section. The lug presents an engagement surface extending below the bridge section and being shiftable relative to the mount. The engagement surface is shiftable into engagement with one of the faces of the ejection port when the mount is mounted on the firearm to prevent movement of the mount relative to the firearm when the firearm is fired.

A second aspect of the present invention concerns a firearm broadly including a receiver presenting an elongated hollow chamber defining a longitudinal axis, hardware associated with the receiver and operable to fire ammunition out of a barrel coupled to the receiver, a base mounted on the receiver, a lug adjustably coupled to the base, and a scope removably coupled to the base. The receiver includes a cartridge ejection port presenting a front face and an oppositely spaced rear face. The front and rear faces are generally perpendicular to the longitudinal axis. The base is mounted on the receiver above the ejection port and includes a bridge section extending over the ejection port. The lug projects out of the bridge section and presents an engagement surface extending below the bridge section and being shiftable relative to the base. The engagement surface is shiftable into engagement with one of the faces of the ejection port to prevent movement of the base relative to the firearm when the firearm is fired.

A third aspect of the present invention concerns a base for mounting a scope on a firearm and broadly includes a mount adapted to be mounted on the firearm and at least one ring clamp adjustably coupled to the mount and operable to clamp the scope to the mount. The ring clamp includes a housing, a first jaw fixed relative to the housing, and an opposed second jaw spaced from the first jaw. The second jaw is shiftable relative to the first jaw and presents a first, a second, and a third engagement surface. The ring clamp further includes a headed fastener rotatably supported relative to the housing. At least a portion of the fastener engages the first engagement surface to cause the second jaw to shift into an engagement position wherein the second engagement surface engages the housing and the third engagement surface engages the mount. At least one of the first, second and third engagement surfaces is arcuate.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figures 1, 2, 3, 5:
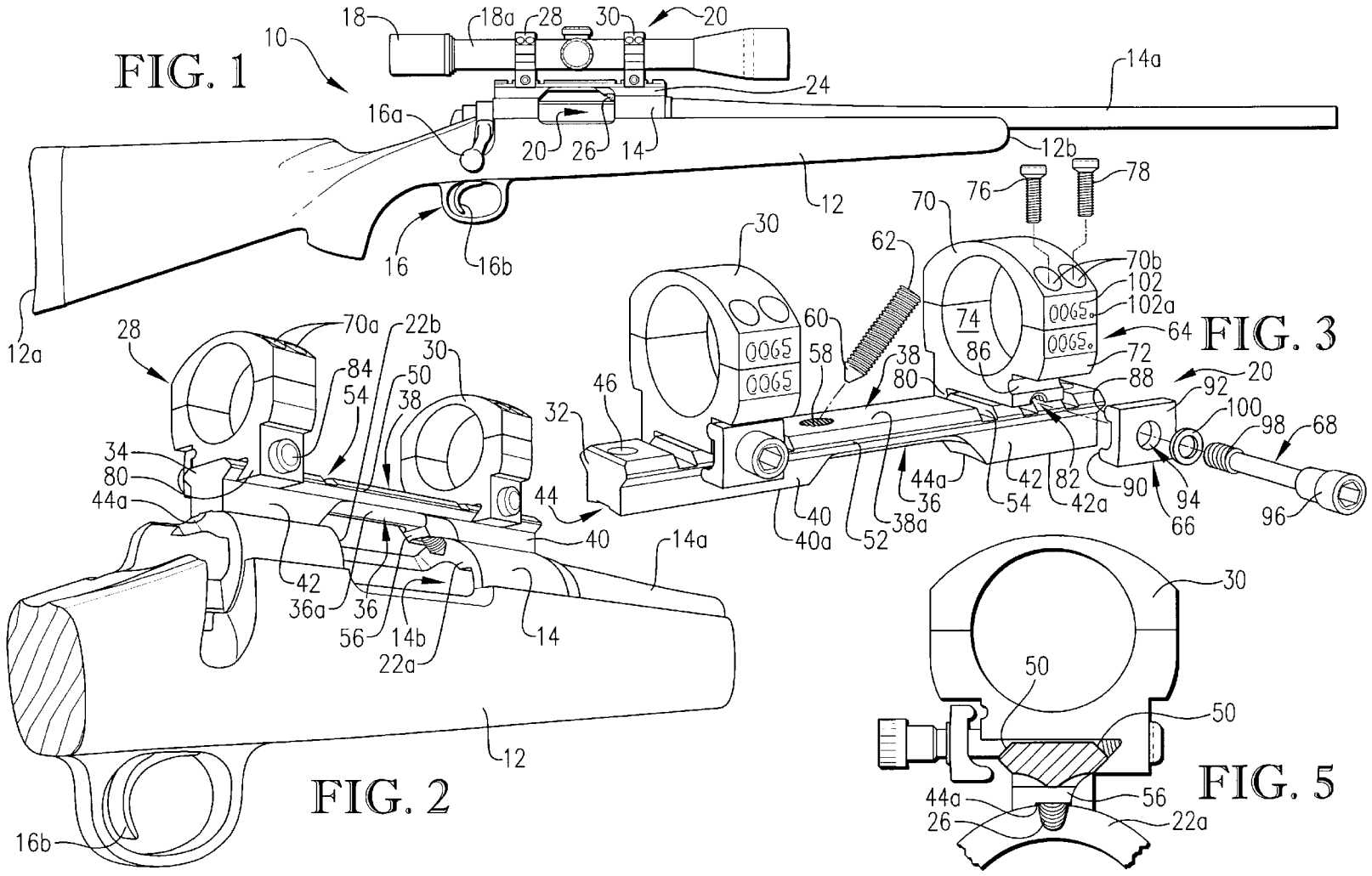
FIG. 1 is a side elevational view of a firearm constructed in accordance with a preferred embodiment of the present invention and including a scope mounted above the ejection port in the firearm receiver by a scope-mounting base having an adjustable recoil lug.
FIG. 2 is a fragmentary rear perspective view of the firearm illustrated in FIG. 1 with portions of the hardware removed to show the adjustable recoil lug engaging the front face of the ejection port.
FIG. 3 is a front perspective view of the scope-mounting base illustrated in FIGS. 1 and 2 with the firearm and scope removed and showing the recoil lug and portions of the back ring clamp exploded in an assembly view.
Figure 6:
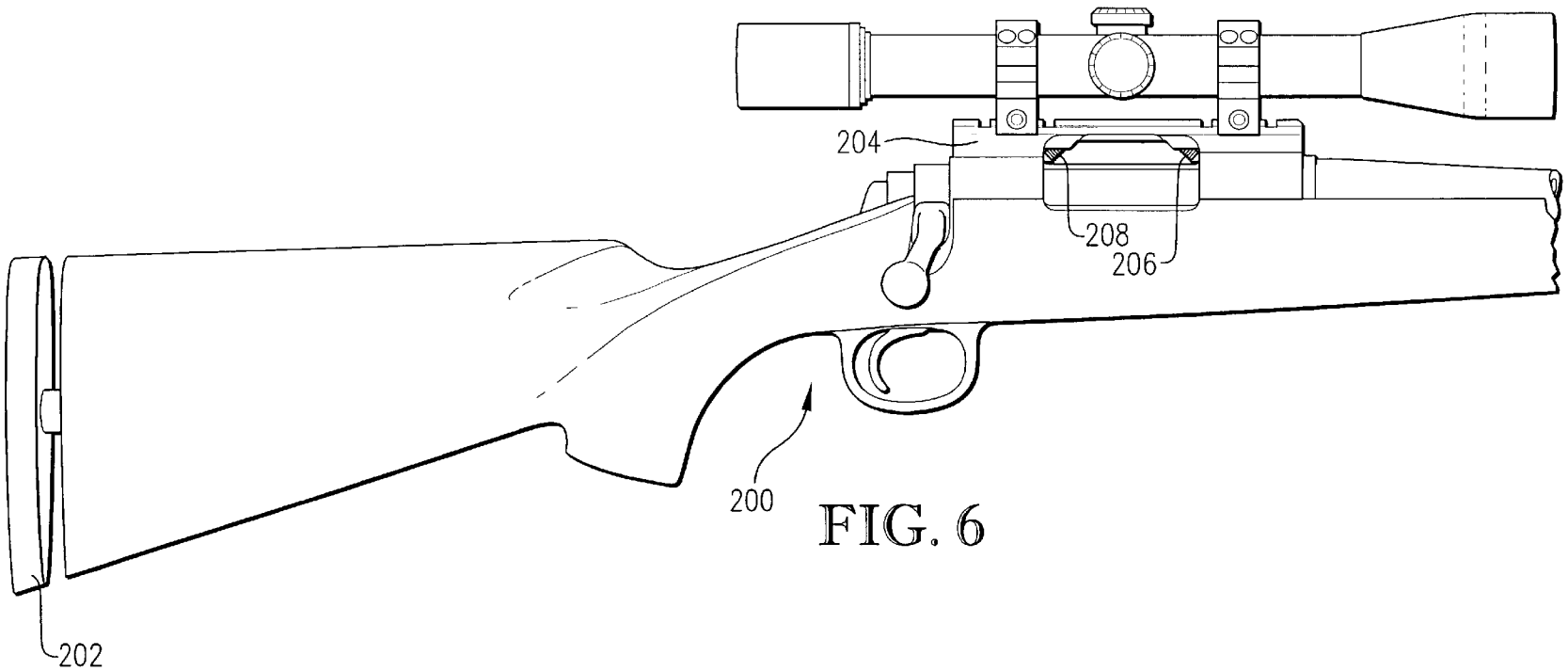

FIG. 5 is a sectional view of the firearm illustrated in FIGS. 1–4 with the receiver shown in fragmentary and the scope removed to illustrate the front face of the ejection port; and FIG. 6 is a fragmentary side elevational view of a firearm constructed in accordance with a preferred alternative embodiment of the present invention and including a recoil-reduction device mounted in the stock and a scope mounted above the ejection port in the firearm receiver by a scope-mounting base having front and rear adjustable recoil lugs.

DETAILED DESCRIPTION OF THE PREFERRED EMBODIMENTS

FIG. 1 illustrates a firearm 10 constructed in accordance with the principles of a preferred embodiment of the present invention and configured for firing large caliber ammunition at precisely defined targets at long range. As detailed below, the illustrated firearm 10 is a rifle having a high-powered scope mounted above the receiver with the inventive scope-mounting base of the present invention. However, the principles of the present invention are not limited to any particular type of firearm or any particular type of scope and are equally applicable to virtually any type of firearm which the user desires to mount some type of scope over the receiver (e.g., handguns, shotguns, military style automatic weapons, etc.). The illustrated firearm 10 broadly includes a stock 12, a receiver 14 supported in the stock 12, a barrel 14*a* threadably coupled to the receiver 14, hardware 16 associated with the receiver 14 for firing ammunition through the barrel 14*a*, a scope 18, and a scope-mounting base 20 coupled to the receiver 14 for mounting the scope 18 thereto in the line of sight.

The stock 12, the receiver 14, the barrel 14*a* and the hardware 16 comprise the traditional components of any conventional firearm and accordingly will only briefly be described herein with the understanding that these components could be variously configured in any manner well known in the art. As shown in FIGS. 1 and 2, the illustrated stock 12 includes a butt end 12*a*, and an opposed front end 12*b*. The stock 12 is configured to receive and support the receiver 14 and the barrel 14*a* extending out of the front end 12*b*. In one manner well known in the art, the stock 12 is further configured to operably receive components of the hardware 16 in the intermediate section between the ends 12*a*, 12*b*. The stock could be formed out of any suitable material such as composites, wood, metal, etc.

The receiver 14 is received within the stock 12 and is configured for receiving ammunition (not shown) and directing the ammunition out of the barrel 14*a* when fired. In one manner well known in the art, the barrel 14*a* is threaded into the receiver 14. Particularly, the illustrated barrel 14 is a single, generally cylindrical barrel. The receiver 14 defines an internal chamber 14*b* and includes a cartridge ejection port 22 located above the intermediate section of the stock 12 and operable to communicate the chamber 14*b* with the ambient atmosphere (see FIGS. 1 and 2). In one manner well known in the art, the ejection port 22 is configured and dimension to cooperate with the hardware 16 to eject from the firearm 10, a spent ammunition cartridge (not shown) after the ammunition has been fired out of the barrel 14. The ejection port 22 presents a front face 22*a* and an opposed rear face 22*b* (see FIGS. 2 and 4). The faces 22*a*, 22*b* are generally flat surfaces formed in the top portion of the cylindrical receiver 14 and are generally perpendicular to the center longitudinal axis of the internal chamber 14*b*. The receiver 14 and the barrel 14*a* are preferably formed of any suitable metal or metal alloy.

In one manner well known in the art, the hardware 16 is associated with the receiver 14 and is configured for loading the ammunition into the receiver 14, firing the ammunition out of the barrel 14*a*, and ejecting the spent cartridge from the receiver 14. The illustrated hardware 16 includes a single action slide bolt 16*a* that communicates with the internal chamber 14*b*, and a firing mechanism including a hammer (not shown) and a trigger 16*b*. As indicated above, the stock 12, the receiver 14, the barrel 14*a* and the hardware 16 are traditional components of a conventional firearm. One such suitable firearm is 700 short available as Model No. 7S.1.20 from Remington. However, the principles of the present invention are not limited to any particular type of firearm and equally apply to virtually any type of firearm.

In one manner well known in the art, the scope 18 is positioned above the receiver 14 to magnify a target in the line of sight of the shooter. The scope 18 could be variously configured but generally presents a cylindrical center section 18*a* configured for receipt within the ring clamps of the base 20 described below. There are several well known commercial manufacturers of suitable scopes for use in the firearm 10 and any scope will suffice.

Figure 4:
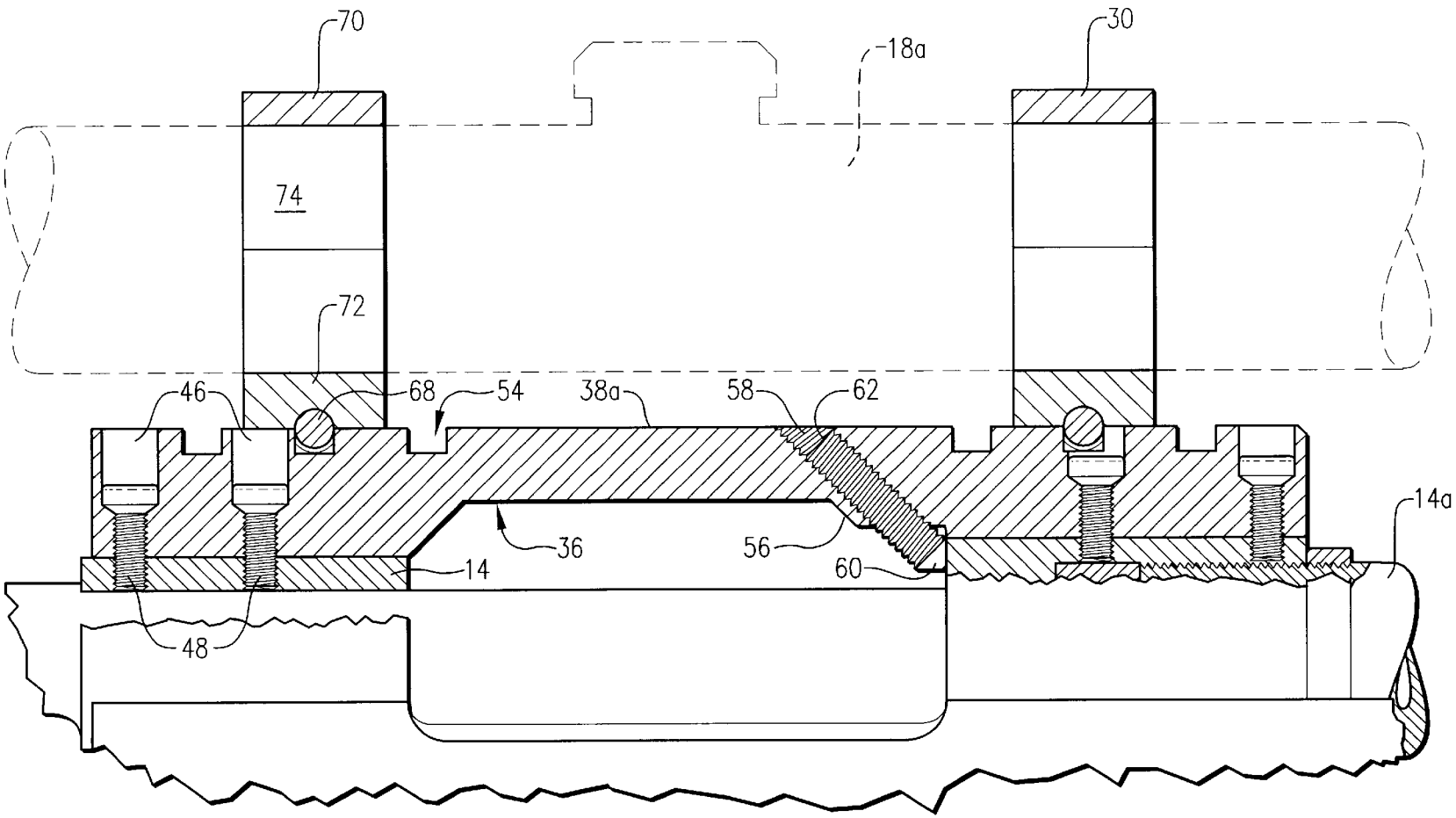
FIG. 4 is an enlarged fragmentary side elevational view of the firearm illustrated in FIGS. 1–3 with the scope-mounting base shown in section and the scope shown in phantom.

Turning now to FIGS. 3–5, the inventive scope-mounting base 20 of the present invention is configured for mounting the scope 18 to the firearm 10 above the ejection port 22 of the receiver 14. The base 18 provides a secure mount for the scope 18 that generally prevents alteration or damage thereto that is typically caused by the large recoil forces of the firearm 10 and enables the base 20 to be configured for use on virtually all variously configured firearms. In more detail, the base 20 includes a mount 24 adapted to be fixed to the receiver 14, an adjustable recoil lug 26 for anchoring the mount 24 relative to the receiver 14, and a pair of ring clamps 28 and 30 for coupling the scope 18 to the mount 24.

The illustrated mount 24 is a weaver-style base that includes a solid, integral body presenting a front end 32 and an opposed rear end 34 with a bridge section 36 positioned between the ends 32,34. The mount 24 includes an enlarged top section 38 extending the length of the mount 24 and presenting a top surface 38*a*. Supporting the top section 38 on the receiver 14 and cooperating with the top section 38 to define the bridge section 36, are a pair of truss sections 40 and 42. The truss sections 40,42 are complementally configured to engage the top arcuate surface of the receiver 14 on either side of the ejection port 22 and maintain the top section 38 generally level. Thus, the rear section 42 extends further from the top surface 38*a* than does the front truss section 40 (see FIG. 4). Each of the truss sections 40,42 present a bottom surface 40*a*, 42*a*, opposite the top surface 38*a*. The bottom surfaces 40*a*,42*a*, are generally arcuate to match the arcuate top surface of the receiver 14. Formed in the bottom surfaces 40*a*,42*a*, is a channel 44 presenting an edge 44*a* recessed relative to the bottom surfaces 40*a*,42*a*, (see FIGS. 3 and 5). The channel 44 is configured and dimensioned to receive a bead of epoxy when assembling the mount 24 to the receiver 14. In this manner, the mount 24 can be securely and evenly centered over virtually any firearm receiver, regardless of its configuration and even where the bottom surfaces 40*a*,42*a*, do not exactly match the top arcuate surface of the receiver. However, it will be appreciated that as is common in the industry, the mount 24 is preferably specifically manufactured to fit the specific type of receiver on which it will be used. The channel 44 could be alternatively configured, for example, the channel could be a V-shaped groove, so long as the channel presents a recessed edge relative to the bottom surface. Formed through the center of the mount 24, and extending between the top surface 38*a* and the channel 44, are a plurality of screw-receiving apertures 46 (see FIG. 4). In one manner known in the art, the apertures 46 receive screws 48 for fastening the mount 24 to the receiver 14. The receiver 14 is preferably complementally drilled when assembling the base 20 thereon, however, the receiver 14 can be pre-drilled (e.g., during manufacture of the firearm components 12,14, 16). The number of apertures 46 is not important, so long as the mount 24 is securely affixed to the receiver 14.

As indicated above, the mount 24 is a weaver-style base. In this regard, the top section 38 of the mount 24 is adapted to adjustably and removably receive the ring clamps 28,30 and includes V-shaped cammed rails 50 and 52 (e.g., forty-five degrees angles) extending along each opposing edge of the section 38 and a plurality of slots 54 extending transversely between the rails 50,52. The cammed rails 50,52 are configured and dimensioned to dovetail with portions of the ring clamps 28,30 as described below. The slots 54 are configured and dimensioned to receive at least a portion of the ring clamp bolt as described below. The top section 38 can be variously alternatively configured so long as the section 38 is adapted to adjustably and removably receive the ring clamps.

The mount 24 is secured to the receiver 14 over the ejection port 22. In this regard, the bridge section 36 is configured and dimensioned to facilitate ejection of the spent cartridge from the receiver 14. Particularly, the bridge section 36 includes an annular channel 36*a* extending around the right-hand side of the section 36 configured to guide the cartridge out and away from the mount 24 (see FIGS. 2 and 5). In this manner, the mount 24 is set up for a right-handed shooter, however, the channel 36*a* could easily be provided on the other side for a left-handed shooter, or on both sides. However, for purposes that will subsequently be described, it is important that the front portion of the bridge section 36 includes a reinforced projection 56 extending at least partially over the ejection port 22 (see FIGS. 2 and 5). The projection 56 preferably extends as far over the ejection port 22 as possible without interfering with the clean ejection of the spent cartridge. In this regard, the illustrated projection 56 is integrally formed in the mount 24 and extends approximately three-eights inch over the port 22. To add stability to the projection 56, the channel 36*a* has only been formed in the right side of the projection 56 and the left side has been left quadrated. For purposes that will subsequently be described, a lug-receiving, internally threaded aperture 58 is formed through the bridge section 36, and extends from the top surface 38*a*, entirely through the bridge section 36, and out of the projection 56 (see FIG. 4).

The recoil lug 26 is adjustably received in the aperture 58 and engages the front face 22*a*, of the ejection port 22 to prevent undesired movement of the base 20 (and thus the scope 18) relative to the receiver 14 during recoil after the firearm 10 is fired. In more detail, the illustrated lug 26 is an externally threaded cylinder with a conical tip 60 and drivable head 62 (see FIG. 3). The external threading complements the internal threading of the aperture 58 so that the lug 26 can be rotated into and out of the aperture 58, thus providing adjustability of the lug 26. The head 62 facilitates manually rotating the lug 26 relative to the aperture 58. The illustrated head has a recessed driver-receiving aperture (not shown) that preferably is adapted to receive an allen-type wrench. The conical tip 60 is configured to cooperated with the aperture 58 to enable the tip 60 to flushly engage the surface of the front face 22*a* of the ejection port 22 as the lug 26 is rotated into the aperture 58. In this regard, the illustrated threaded aperture 58 is oriented at a forty-five degree angle relative to the bridge section 36. The tip 60 is complementally configured with forty-five degree surfaces. In this manner, the tip 60 is positioned parallel to the orthogonal face 22*a* of the port 22 and thus is caused to flushly engage the face 22*a* when the lug 26 is driven sufficiently into the aperture 58. It will be appreciated that the lug 26 can be manufactured by modifying most standard threaded fasteners. One suitable fastener is one-quarter inch number twenty-eight, socket head set screw. The angled aperture 58, the angled surface of the tip 60, and the adjustability of the recoil lug 26 cooperate to enable the lug 26 to be used on virtually any base with any firearm having an ejection port without the need to specially manufacture the lug for the particular firearm. It will be appreciated that only slight modifications to a standard base (e.g., forming the angled, threaded aperture therein) will be necessary. The lug 26 preferably includes means to prevent the lug 26 from loosening once the lug 26 is securely in position against the face 22*a*. Any suitable fastener anti-loosening means known in the art will suffice, including for example mechanical means such as a set screw or a locking nut, chemical means such as those sold under the designation Blue Lock Tight, or other means such as a nylon patch. It is within the ambit of the present invention to use various alternative configurations for the adjustable lug 26, for example the drivable head could be configured to receive any suitable driver, the adjustability need not be provided with complemental threading, and the complemental angles of the threaded aperture and the conical tip need not be forty-five degrees. However, it is important that the lug be adjustable and generally prevent undesired movement of the base during recoil. Because most conventional ejection ports present a generally orthogonal face, the angles utilized for the threaded aperture and the conical tip are preferably complemental (e.g., thirty/sixty degrees, etc.).

The ring clamps 28,30 couple the scope 18 to the mount 24. As detailed below, the inventive ring clamps 28,30 are a matched set including arcuate engagement surfaces that enable a consistently uniform and optimized torque applied between the ring clamps 28,30 and the mount 24 that further prevent any undesired movement of the scope 18 during recoil. Each of the clamps 28,30 are virtually identically configured and therefore only the ring clamp 28 will be described in detail with the understanding that the ring clamp 30 is similarly constructed. As shown in FIG. 3, the ring clamp 28 includes a clamp housing 64, a shiftable jaw 66, and a fastener 68 associating the jaw 66 with the housing 64. In more detail, the housing 64 includes an upper bracket 70 and a lower bracket 72 that are adjustably coupled to define an annular seat 74 for receiving the cylindrical center section 18*a* of the scope 18. The upper bracket 70 includes two pair of keyways 70*a* and 70*b* (see FIGS. 2 and 3) for receiving corresponding pairs of screws (with only the screws 76 and 78 received within the keyways 70*b* being shown). The lower bracket includes corresponding pairs of threaded apertures (not shown) that align with the keyways 70*a*,70*b* for threadably receiving the screws 76,78 to adjustably couple the upper and lower brackets 70,72. The lower bracket 72 includes an integrally formed jaw 80 that is configured and dimensioned to dovetail with the rail 50 (see FIG. 5 showing the similar structure of the ring clamp 30). For purposes that will subsequently be described, the lower bracket 72 further includes a keyway 82 that extends along the bottom of the bracket 72 and into the jaw 80, and an internally threaded nut 84 fixed to the jaw 80 and axially aligned with the keyway 82 (sec FIGS. 2 and 3). Formed in the lower bracket 72 above the keyway 82 and opposite the jaw 80 is an arcuate clamping surface 86. The surface 86 extends the width of the lower bracket 72 and is generally semicircular in configuration. The lower bracket 72 is sized and dimensioned to slide on the top section 38 of the mount 24 so that the keyway 82 aligns over one of the slots 54. The plurality of slots 54 enable the ring clamps 28,30 to be adjustably spaced to accommodate various sized scopes.

The housing 64 is secured to the mount 24 by the movable jaw 66 and the fastener 68. In more detail, the jaw 66 is a generally C-shaped jaw that presents upper and lower engagement surfaces 88 and 90, an opposed rear face 92, and a center aperture 94. The upper engagement surface 88 is complementally configured to matingly engage the arcuate clamping surface 86 of the lower bracket 72 and accordingly is generally semi-circular in configuration. The lower engagement surface 90 is configured and dimensioned to dovetail with the rail 52 of the mount 24. However, unlike the jaw 80, the lower engagement surface 90 is arcuate, being generally semi-circular in configuration. The movable jaw 66 is shiftable relative to the housing 64 into and out of an engagement position (as shown in FIGS. 1 and 2 and perhaps as best illustrated by the ring clamp 30 in FIG. 3) wherein the upper engagement surface 88 engages the clamping surface 86 and the lower engagement surface engages the rail 52. When in the engagement position, the bottom of the lower bracket 72 is pulled into tight engagement with the top surface 38*a* of the top section 38 of the mount 24 to tightly secure the clamp 28 centered over the mount 24.

The movable jaw 66 is caused to shift relative to the lower bracket 72 by the fastener 68. The illustrated fastener 68 is a bolt-type fastener with an enlarged head 96 and an opposite externally threaded end 98. The fastener 68 is sized and dimensioned so that the end 98 is received through the center aperture 94, passes through the keyway 82 (and the aligned slot 54 as shown in FIG. 4) and is threadably received in the nut 84 of the lower bracket 72. When the fastener 68 is received in the lower bracket 72, the head 96 engages the rear face 92 and causes the jaw 66 to shift as the end 98 threads into the lower bracket 72. The illustrated fastener 68 includes a washer 100 that rides between the head 96 and the rear face 92. The illustrated head 96 is a drivable head that is configured to receive an allen-type wrench for rotating the fastener 68 and also includes a knurled outer surface to facilitate manual rotation by hand. The fastener 68 preferably includes a sufficiently low profile to enable the fastener to be received as much as possible within the slots 54 so the clamping force provided by the clamp 28 is applied as low as possible along the top section 38 of the mount 24. In this regard, the clamping force is preferably and optimally applied and centered along the axis of the fastener 68. However, because the jaw 66 may not always precisely and squarely align with the rail 52, sometimes the jaw 66 will be slightly angled relative to the rail 52 thus undesirably transferring the clamping force unevenly to one of the engagement surfaces 88,90. To reduce this undesired transfer (i.e., and the "spongy" coupling that results from this transfer), the illustrated rear surface 92 is an arcuate surface. In this manner, as the jaw 66 is inclined to align out of kilter, the force applied by the head 96 remains generally applied along the center of the fastener 68. The arcuate nature of the engagement surfaces 88,90 facilitate this corrective transfer (i.e., the surfaces 88,90 can rotate slightly given their radial configuration). In this manner, the ring clamp 28 provides a tight and secure coupling with the mount 24 that does not present the undesirable "spongy" connection of the prior art ring clamps.

As previously indicated, the ring clamp 30 is virtually identically configured as the ring clamp 28 previously described in detail. The ring clamps 28,30 are a matched set. That is to say, each of the clamps 28,30 are specifically machined and manufactured to fit with the particular mount 24. In this regard, the illustrated clamps 28,30 each include corresponding labeling 102 to designate the matched set during manufacture (see FIG. 3). Additionally, each of the illustrated clamps 28,30 are specifically manufactured to fit together (e.g., the upper and lower brackets 70,72 are not interchangeable with other brackets). In this regard, the corresponding labeling 102 includes a portion 102*a*, on the upper and lower brackets 70,72 that distinguish these components from the corresponding components of the clamp 30. Although the ring clamps 28,30 are preferably used with mount 24, the three arcuate surfaces 88,90,92 enable the rings to be used with any weaver-style mount. Even where the mount used does not exactly match the clamps 28,30, the arcuate surfaces 88,90,92 provide a more optimal transfer of the clamping force along the center of the fastener 68 than provided with prior art, flat surfaced ring clamps. It is within the ambit of the present invention to utilize various alternative configurations for the ring clamps 28,30 and any suitable ring clamps could be utilized. However, it is preferred that the ring clamps provide at least one arcuate engagement surface for the reasons detailed above. If only one arcuate engagement surface is utilized, it is preferably the rear face of the movable jaw to provide the best adjustable alignment of the clamping force.

In operation, the mount 24 is first secured to the receiver 14 with the screws 48. Next, the adjustable lug 26 is threaded through the aperture 58 until the conical tip 60 securely engages the front face 22*a*, of the ejection port 22. Once the mount 24 is secured, the scope 18 is coupled to the ring clamps 28,30 by securing the upper and lower brackets 70,72 around the cylindrical center section 18*a* and tightening the screws 76,78. The scope-laden ring clamps 28,30 are then slid over the rails 50,52 of the top section 38 of the mount 24 until the fastener 68 aligns with one of the slots 54. The fastener 68 is then tightened until the movable jaw 66 is in the engagement position to firmly secure the ring clamps 28,30 to the mount 24. The base 20 is now secured and the firearm 10 can be fired without the recoil forces undesirably altering the focus of the scope 18 or damaging the scope 18.

As indicated above, it is within the ambit of the present invention to utilize various alternative configurations for the scope-mounting base. One such suitable alternative embodiment is shown in the firearm 200 illustrated in FIG. 6. The firearm 200 is similar in most respects to the previously described firearm 10, however, the firearm 200 includes a recoil-reduction device 202 mounted in the stock and a scope-mounting base 204 having both front and rear adjustable recoil lugs 206 and 208, respectively. In one manner known in the art, the illustrated recoil-reduction device 202 is a hydraulic device that offsets some of the extreme recoil forces. The recoil-reduction device 202 could be any suitable device known in the art including for example muzzle brakes. It will be appreciated, that recoil-reduction devices offset the recoil forces, however, by doing this, they also tend to enact forces on the scope acting in the opposite direction of the recoil forces. In this regard, the illustrated base 204 includes the rear recoil lug 208 in addition to the front recoil lug 206. The recoil lugs 206,208 are virtually identically configured and configured similarly to the previously described adjustable recoil lug 26. However, the rear recoil lug 208 engages the rear race of the cartridge ejection port.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A base for mounting a scope on a firearm wherein the firearm includes a cartridge ejection port presenting a front face and a rear face, said base comprising:

a mount adapted to be mounted on the firearm, said mount including a bridge section extending over the ejection port when the mount is mounted on the firearm; and a lug adjustably coupled to the mount and projecting out of the bridge section, said lug presenting an engagement surface extending below the bridge section and being shiftable relative to the mount, said engagement surface being shiftable into engagement with one of the faces of the ejection port when the mount is mounted on the firearm to prevent movement of the mount relative to the firearm when the firearm is fired.

2. The base as claimed in claim 1, said engagement surface being shiftable into engagement with the front face of the ejection port when the mount is mounted on the firearm.

3. The base as claimed in claim 2; and an additional lug spaced from said first-mentioned lug and being adjustably coupled to the mount and projecting out of the bridge section, said additional lug presenting an additional engagement surface extending below the bridge section and being shiftable relative to the mount, said additional engagement surface being shiftable into engagement with the rear face of the ejection port when the mount is mounted on the firearm to prevent movement of the mount relative to the firearm when the firearm is fired.

4. The base as claimed in claim 1, said engagement surface being shiftable into engagement with the rear face of the ejection port when the mount is mounted on the firearm.

5. The base as claimed in claim 1, said lug being threadably coupled to the mount.

6. The base as claimed in claim 5, said bridge section presenting a top generally flat surface and an oppositely spaced bottom surface, said mount including a threaded aperture formed in the bridge section and extending between the top and bottom surfaces, said lug including a shaft threadably received in the aperture.

7. The base as claimed in claim 6, said shaft defining a longitudinal center axis, said axis forming a first angle with the top surface, said first angle being an oblique angle.

8. The base as claimed in claim 7, said lug including a conical tip formed in the shaft, said tip presenting the engagement surface, said engagement surface defining a second angle relative to the axis, said first and second angles being complementary angles.

9. The base as claimed in claim 7, said first angle being forty-five degrees.

10. The base as claimed in claim 1, said mount presenting a top surface and an oppositely spaced bottom surface, said bottom surface at least partially engaging the firearm when the mount is mounted on the firearm.

11. The base as claimed in claim 10, said bottom surface defining a recessed edge extending along the bottom surface, said recessed edge being spaced from the firearm when the mount is mounted to the firearm.

12. A firearm comprising:

a receiver presenting an elongated hollow chamber defining a longitudinal axis, said receiver including a cartridge ejection port presenting a front face and an oppositely spaced rear face, said font and rear faces being generally perpendicular to the longitudinal axis;

hardware associated with the receiver and operable to fire ammunition out of a barrel coupled to the receiver;

a base mounted on the receiver above the ejection port, said base including a bridge section extending over the ejection port;

a lug adjustably coupled to the base and projecting out of the bridge section, said lug presenting an engagement surface extending below the bridge section and being shiftable relative to the base, said engagement surface being shiftable into engagement with one of the faces of the ejection port to prevent movement of the base relative to the firearm when the firearm is fired; and a scope removably coupled to the base.

13. The firearm as claimed in claim 12, said engagement surface being shiftable into engagement with said front face.

14. The firearm as claimed in claim 13; and an additional lug spaced from said first-mentioned lug and being adjustably coupled to the base and projecting out of the bridge section, said additional lug presenting an additional engagement surface extending below the bridge section and being shiftable relative to the base, said additional engagement surface being shiftable into engagement with said rear face to prevent movement of the base relative to the firearm when the firearm is fired.

15. The firearm as claimed in claim 12, said engagement surface being shiftable into engagement with said rear face.

16. The firearm as claimed in claim 12, said lug being threadably coupled to the base.

17. The firearm as claimed in claim 16, said bridge section presenting a top generally flat surface and an oppositely spaced bottom surface, said base including a threaded aperture formed in the bridge section and extending between the top and bottom surfaces, said lug including a shaft threadably received in the aperture.

18. The firearm as claimed in claim 17, said shaft defining a longitudinal center axis, said axis forming a first angle with the top surface, said first angle being an oblique angle.

19. The firearm as claimed in claim 18, said lug including a conical tip formed in the shaft, said tip presenting the engagement surface, said engagement surface defining a second angle relative to the axis, said first and second angles being complementary angles.

20. The firearm as claimed in claim 18, said first angle being forty-five degrees.

21. The firearm as claimed in claim 12, said base presenting a top surface and an oppositely spaced bottom surface, said bottom surface at least partially engaging the receiver.

22. The firearm as claimed in claim 21, said bottom surface defining a recessed edge extending along the bottom surface, said recessed edge being spaced from the receiver.

* * * * *